United States Patent [19]

Iqbal et al.

[11] Patent Number: 4,915,347

[45] Date of Patent: Apr. 10, 1990

[54] SOLENOID OPERATED FAUCET

[75] Inventors: Muhammad Iqbal; Jeffery J. Kreutzer, both of Sheboygan; Carl R. Schwartz, Mequon, all of Wis.

[73] Assignee: Kohler Co., Kohler, Wis.

[21] Appl. No.: 353,569

[22] Filed: May 18, 1989

[51] Int. Cl.[4] ..... E03C 1/05; F16K 31/02; F16K 31/126

[52] U.S. Cl. ..... 251/30.03; 4/623; 137/605; 137/801; 222/63; 250/221; 250/341; 251/30.05; 251/38; 251/45; 251/129.04

[58] Field of Search ..... 4/304, 305, 623; 137/606, 607, 801, 605; 250/221, 341; 222/63; 251/129.03, 129.04, 129.11, 30.02, 30.03, 30.04, 30.05, 45, 46, 38

[56] References Cited

U.S. PATENT DOCUMENTS

| | | | |
|---|---|---|---|
| 2,461,722 | 2/1949 | Ray . | |
| 3,441,246 | 4/1969 | Lauppe et al. | 251/52 |
| 3,505,692 | 4/1970 | Forbes | 4/623 |
| 3,575,640 | 4/1971 | Ishikawa | 317/146 |
| 3,576,277 | 4/1971 | Blackmon | 222/1 |
| 3,639,920 | 2/1972 | Griffin et al. | 4/623 |
| 3,670,167 | 6/1972 | Forbes | 250/221 |
| 3,671,009 | 6/1972 | Stampfi | 251/129 |
| 3,763,881 | 10/1973 | Jones | 251/45 |
| 3,799,198 | 3/1974 | Kijimoto | 137/624 |
| 4,222,410 | 9/1980 | Geimer | 251/45 |
| 4,402,095 | 9/1983 | Pepper | 4/623 |
| 4,520,516 | 6/1985 | Parsons | 4/623 |
| 4,558,844 | 12/1985 | Donahue, Jr. | 251/118 |
| 4,604,764 | 8/1986 | Enzo | 4/623 |
| 4,651,177 | 3/1987 | Hardman | 137/487 |
| 4,681,141 | 7/1987 | Wang | 4/623 |
| 4,682,628 | 7/1987 | Hill | 137/624.11 |
| 4,709,728 | 12/1987 | Ying-Chung | 4/623 |
| 4,735,357 | 4/1988 | Gregory et al. | 236/93 |
| 4,762,273 | 8/1988 | Gregory et al. | 236/93 R |
| 4,793,588 | 12/1988 | Laverty, Jr. | 251/30.03 |

*Primary Examiner*—George L. Walton
*Attorney, Agent, or Firm*—Quarles & Brady

[57] ABSTRACT

A faucet has a body with a hollow inner cavity and a spout which opens into the inner cavity. A valve assembly is located within the inner cavity to control the flow of water from a source into the spout. The valve assembly comprises a housing with an inlet chamber which opens into a ring-shaped channel, an outlet chamber having an opening centrally located with respect to the ring of the channel, and a diaphragm to selectively close the communication of the inlet and outlet chambers. A solenoid includes a plunger that is biased by a spring against the diaphragm and an electromagnetic coil to pull the plunger away from the diaphragm. A proximity sensor is included to detect the presence of an object adjacent the faucet and energize the coil. A safeguard alarm mechanism is provided to deenergize the coil after a given interval if the object continues to be detected and thereafter periodically briefly energize the solenoid until the object is removed.

10 Claims, 5 Drawing Sheets

SOLENOID OPERATED FAUCET

BACKGROUND OF THE INVENTION

The present invention relates to faucets which incorporate a solenoid valve enabling the faucet to be operated by an electrical signal. In a preferred form, it relates to such faucets controlled by a proximity detector which senses the presence of an object adjacent the faucet and activates the solenoid valve.

In hospitals, public rest rooms, and other facilities, it is desirable to provide a lavatory faucet which can be turned on and off without requiring the user to touch the faucet. The prior art is replete with devices for sensing the presence of a user and in response thereto activating a solenoid valve coupled to a faucet. A common sensing technique involves transmitting an infrared light beam into a region in front of the faucet where a user may place his hands. A sensor is mounted either in or adjacent the faucet to detect the infrared light reflected by the user, thereby sensing the presence of a user in front of the faucet. In response to sensing the reflected light, the solenoid valve is opened causing water to flow from the faucet. When the detection of reflected light ceases, the valve is deenergized.

A problem with such proximity activated faucets is that an inanimate object can be left within the sensing region (e.g. by vandals) thereby causing the water to flow continuously. This activation of the faucet not only wastes water, but may result in water overflowing the lavatory if some object is also blocking the drain and overflow openings.

The previous electrically activated faucets typically incorporated the solenoid valve assembly beneath the wash basin, totally separate from the faucet. In addition, the proximity sensing circuitry was similarly housed in a separate enclosure. It is desirable in many applications of such faucets to reduce the amount of space consumed by the various components and integrate them into the faucet housing. However in doing so, it is important to be able to gain access to the different components in order to perform routine maintenance.

Other problems with the prior art related to the operating of the closure mechanism of the solenoid valve, especially in the design of the metering hole used to permit closure.

SUMMARY OF THE INVENTION

A faucet has a body within which is located a separable valve housing. The valve housing forms an inlet chamber, which opens into an annular channel, and an outlet chamber with a opening centrally located relative to the annular channel. A surface between the channel and the outlet chamber opening defines a valve seat. A portion of the valve housing extends into a spout of the faucet body and has an aperture providing a conduit between the outlet chamber and the spout.

A resilient diaphragm abuts the valve seat and the housing to selectively seal the outlet chamber from the inlet chamber. This diaphragm has a centrally located aperture which communicates with the outlet chamber and has a metering aperture which opens into the inlet chamber. A taper pin on the valve housing passes through and restricts metering aperture when the diaphragm abuts the valve seat. A diaphragm retainer is positioned in the central aperture of the diaphragm and includes an aperture which communicates with the outlet chamber.

A solenoid assembly is mounted on the valve housing to form a cavity therebetween into which the metering aperture and the diaphragm retainer aperture communicate. The solenoid assembly includes a plunger biased by a spring against the retainer disc to releasably seal its aperture. An electrical coil extends around the plunger.

The preferred embodiment of the faucet incorporates a proximity sensor for detecting the presence of an object adjacent the faucet and in response thereto for energizing the electrical coil. The proximity sensor includes a safety shut off circuit which deenergizes the coil after a preset period even though an object may continue to be detected. Thereafter, the faucet is periodically opened as an alarm system until the object is removed.

A general objective of the present invention is to provide a solenoid operated faucet in which the solenoid is enclosed within the faucet housing.

It is another objective to create a modular faucet assembly which can be disassembled easily for servicing.

Yet another objective of the present invention is to provide a proximity detector which will sense the presence of a user in front of the faucet and activate the solenoid to open the valve.

A still further objective is to provide a mechanism which minimizes the undesirable effects caused by an object being left within the sensing region of the faucet.

DESCRIPTION OF THE PREFERRED EMBODIMENT

Figure 1:
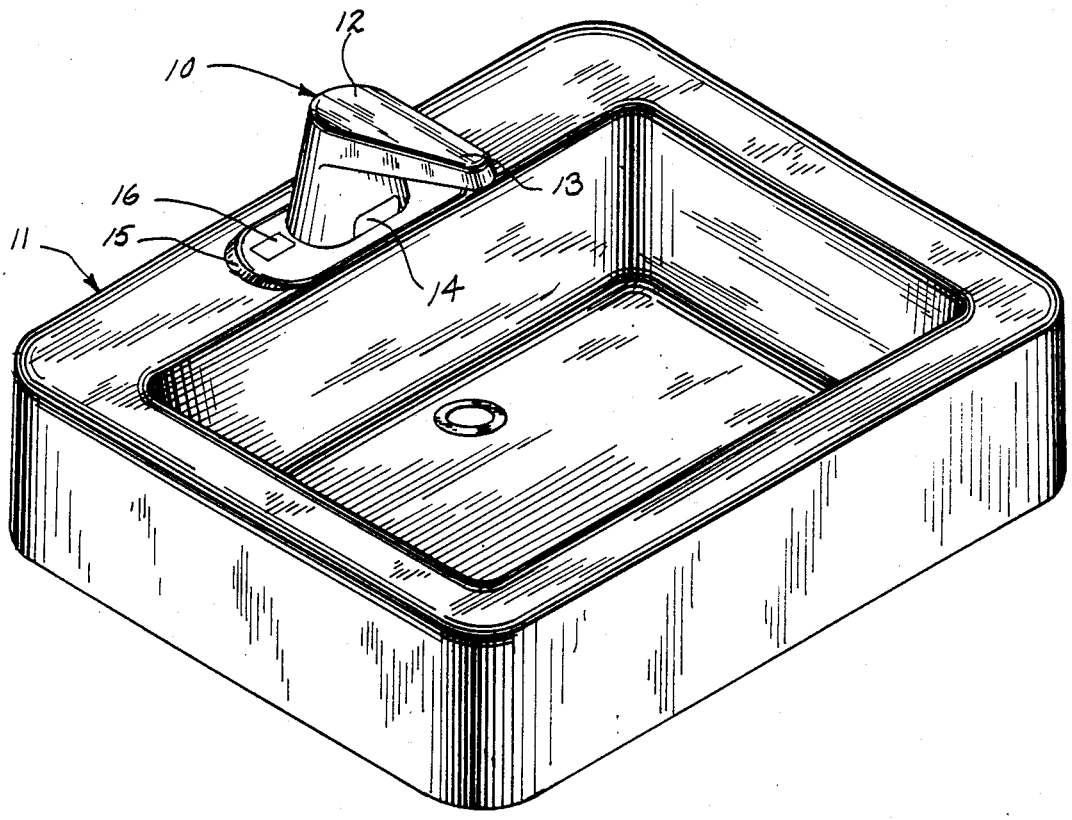
FIG. 1 is an isometric view of a faucet according to the present invention mounted on a lavatory.

With initial reference to FIG. 1, a faucet 10 is mounted on a lavatory 11. The faucet includes a body 12 having a tubular spout 13 extending over the bowl of the lavatory. At the front of the faucet body 12, beneath the spout 13, is a conventional infrared proximity detector 14 which senses the presence of an object, such as a person's hands, beneath the spout 13. The faucet 10 also has a base 15 on which the faucet body 12 is mounted. The base includes a temperature display 16 comprising an array of light emitting diodes (LED) forming a bar graph which provides a visual indication of the temperature of the water flowing from the spout.

Figure 2:
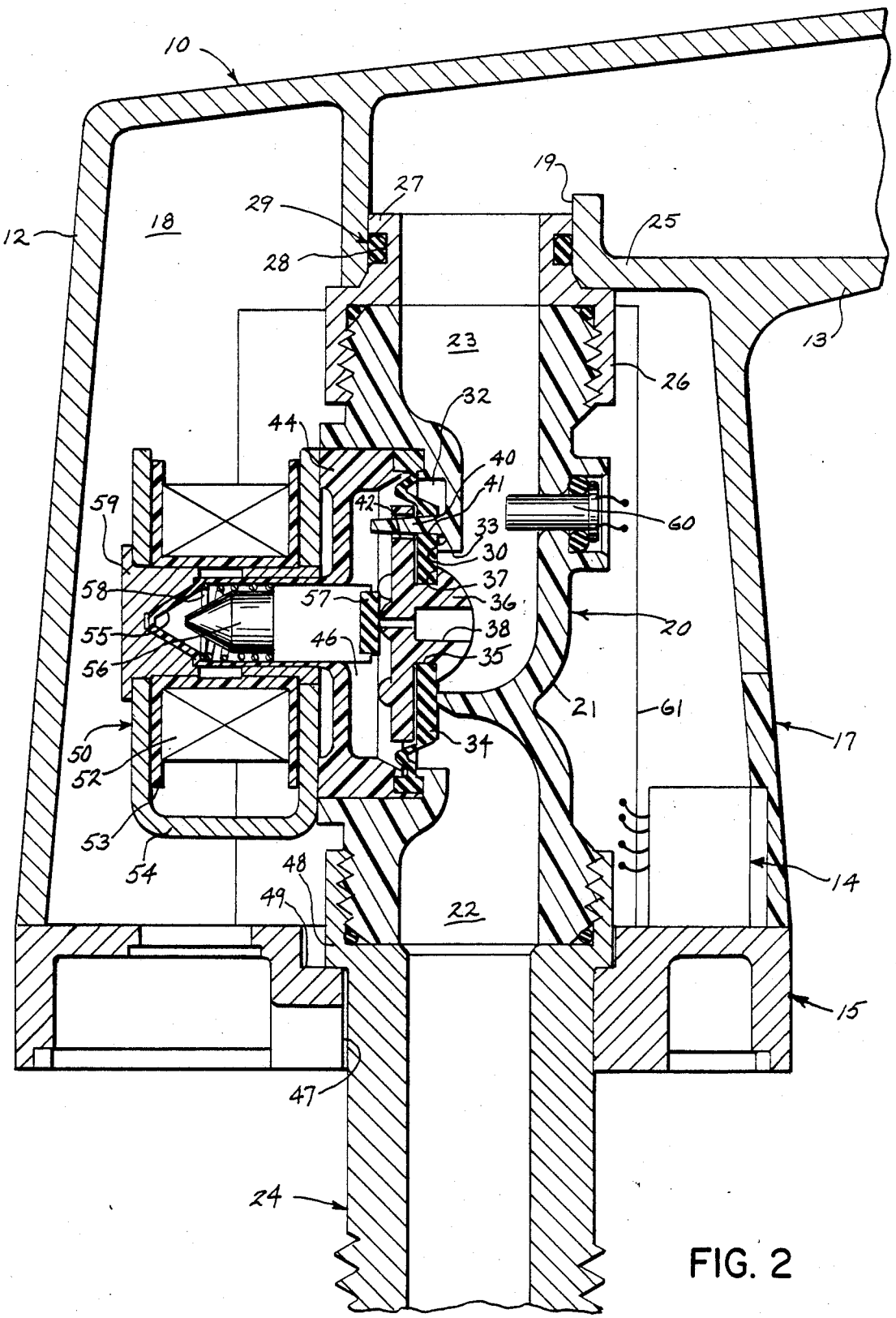
FIG. 2 is a vertical cross sectional view of the faucet in FIG. 1.

As shown in FIG. 2, the metal faucet body 12 has a hollow inner chamber 18 communicating with the spout 13 via a circular opening 19 in inner wall 25. Located within the inner chamber 18 is a solenoid valve assembly 20, that includes a valve housing 21 formed of a plastic material and having an inlet chamber 22 and an outlet chamber 23. The upper end of the valve housing 21 adjacent the outlet chamber 23 is threaded into an adapter 26. The adapter 26 has a non-threaded cylindrical portion 27 slid into the circular opening 19 between the inner chamber 18 and the spout 13. The cylindrical portion 27 has an external peripheral groove 28 within which an O-ring 29 is located to provide a water-tight seal between the adapter 26 and the faucet housing wall 25. Alternatively, the valve housing 21 and the adapter 26 can be formed as a single unit. Therefore, the adapter 26 can be considered as part of the valve housing.

The lower end of the valve housing 21 is threaded into to a brass tube 24 which extends through aperture 47 in the base 15 and couples a water supply pipe (not illustrated) to the inlet chamber 22. As the faucet 10 has a single water inlet chamber 22, hot and cold water may have to be premixed upstream from the faucet. Alternatively, a mixing valve could be included in the faucet body 12. The tube 24 has an external flange 48 which is received in a rim 49 around the base aperture 47. Alternatively, the flange 48 can be located on the lower end of the valve housing 21. The engagement of the flange 48 and the rim 49 holds the valve assembly 20 within the faucet preventing the cylindrical portion 27 from sliding out of the opening 19. Both the inlet chamber 22 and the outlet chamber 24 communicate coaxially through the middle side of the valve housing 21. The inlet chamber 22 communicates with a ring-shaped channel 32 and the outlet chamber 23 opens into the center 33 of the ring shaped channel. The intersection between the two openings forms a circular valve seat 30.

A resilient diaphragm 34 extends across the opening in the side of the valve housing 21. The diaphragm 34 has a central aperture 35 through which a disk shaped retainer 36 extends with the diaphragm positioned in an external groove 37 of the retainer. The retainer is tightly fitted within the central opening of the diaphragm so as to provide a water-tight seal therebetween. The diaphragm retainer 36 has a central aperture 38 extending therethrough providing a passage connecting the outlet chamber 23 with a cavity 46 on the opposite side of the diaphragm. The retainer 36 extends across the surface of the diaphragm 34 which is remote from the valve seat 30. The diaphragm 34 also has a metering hole 41 through it aligned with a similar hole 42 in the retainer 36. The valve housing 21 has a tapered pin 40 extending through both of these holes 41 and 42.

A plunger housing 44 abuts the periphery of the diaphragm 34 holding it tightly against the valve housing 21, forming a water-tight seal between the periphery of the diaphragm and the valve housing as well as the plunger housing. The plunger housing 44 includes a cylindrical portion 55 extending centrally therefrom and terminating at a closed end. Cavity 46 is formed by the plunger housing 44, retainer 36 and diaphragm 34.

A conventional solenoid coil assembly 50 encircles the cylindrical portion 55 of the plunger housing 44 and includes an electrical coil 52 wound onto a plastic spool 53. A U-shaped bracket 54 partially encompasses the coil 52 and has three screws (not shown) fastening the solenoid coil assembly 50 to the valve housing 21. A cylindrical solenoid plunger 56, formed of magnetic material, is within the cylindrical portion 55 of the plunger housing. The solenoid plunger has a resilient button 57 at one end which is biased against the retainer 36 by a spring 58 to seal the central aperture 38 when the solenoid coil 52 is deenergized. The solenoid coil assembly 50 further includes a metallic plug 59 within the central opening of the spool 53 and across the end of the cylindrical portion 55 of the insert 44.

The infrared proximity detector 14 is located within the faucet body 12 behind a plastic window 17 which is transparent to infrared radiation. A temperature sensor 60, such as a thermistor, extends through an opening in the valve housing 21 to sense the temperature of the water within the outlet chamber 23. The resistivity of the temperature sensor 60 varies with the water temperature.

Figure 3:
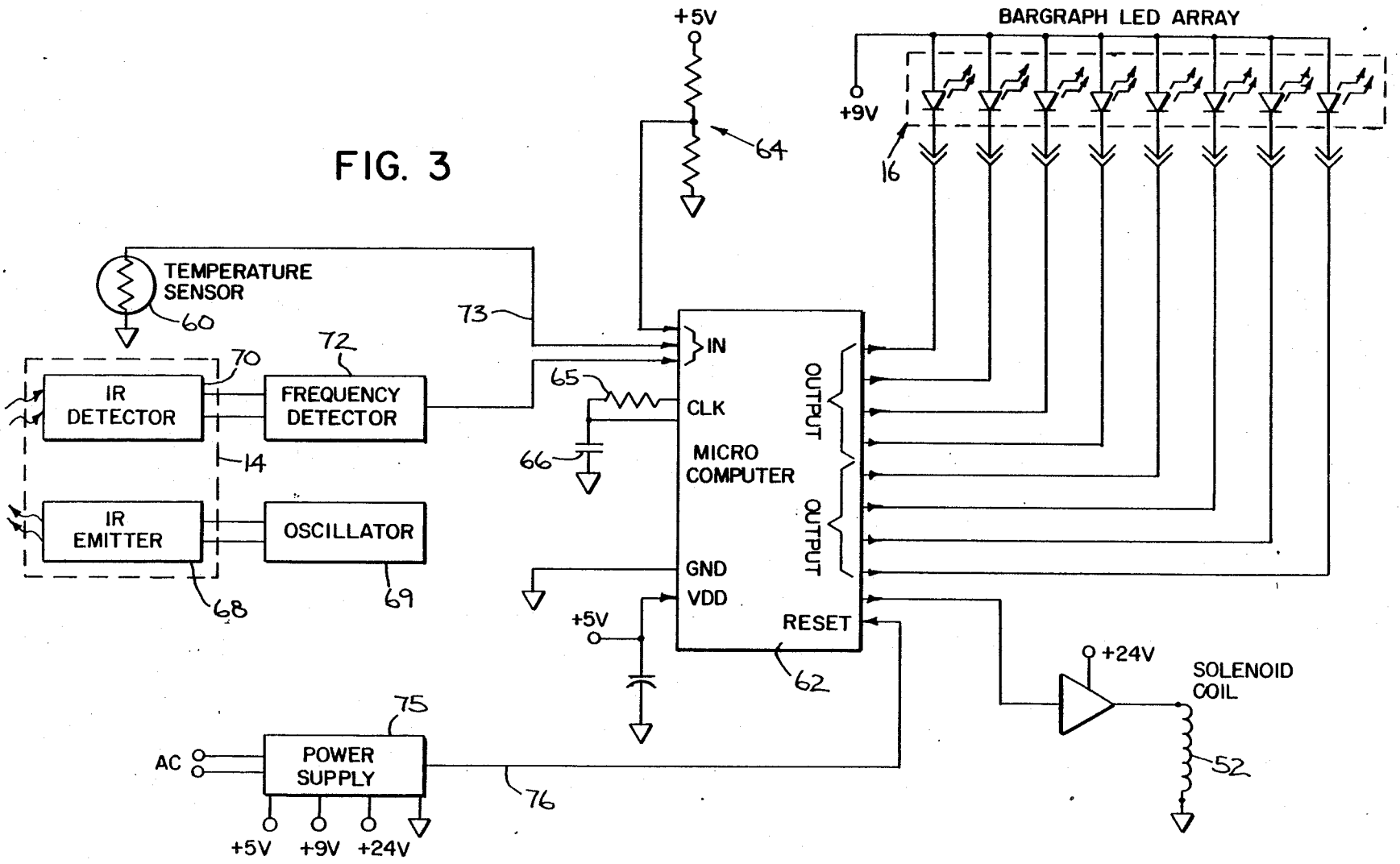
FIG. 3 is a schematic block diagram of the electrical control circuit of the present invention.

An electrical control circuit is mounted on a printed circuit board 61 within the inner chamber 18 of the faucet housing 12. The details of this circuit are shown in FIG. 3. The control circuit is built around a commercially available microcomputer 62 which includes an integral analog-to-digital converter and a memory for storing a control program for the faucet. An RC circuit consisting of resistor 65 and capacitor 66 is coupled to the clock input terminals of the microcomputer 62. The temperature sensor 60 is connected to the analog-to-digital converter input of the microcomputer 62. The analog-to-digital converter also receives a reference voltage from a voltage divider 64 for use in digitizing the signal from the temperature sensor 60.

The proximity detector 14 comprises an infrared light emitting diode (IR LED) 68 which is driven by an oscillator circuit 69 to emit pulses of light at a fixed frequency. The infrared light from the LED 68 is transmitted through the window 17 of the faucet housing (FIG. 2) and radiates in a conical pattern in front of the faucet. The proximity sensor array detector 14 also includes at least one infrared detector 70 which changes its conductivity in response to infrared light. If a wider sensing region is desired, additional detectors can be incorporated. The infrared detector 70 is coupled to an input of a frequency detector 72 which is tuned to detect a pulsed signal having the same frequency as oscillator 69. The frequency detector prevents ambient infrared light from triggering the circuit to open the solenoid valve. The output signal of the frequency detector 72 is coupled by line 73 to an input of microcomputer 62 and indicates when light is reflected from LED 68 to the infrared detector 70.

The microcomputer 62 has two four-bit latched output ports, each bit line of which is coupled to one of the LED's in the display array 16. Another latched output line of the microcomputer 62 is connected to the input of a solenoid driver 74 whose output is coupled to the coil 52 of the solenoid assembly 50.

The control circuit also includes a power supply 75 which converts 120 volt alternating line current into the proper low DC voltage levels for powering the control circuit. As is a customary practice, the high voltage portions of the power supply 75 are located away from the faucet body 12 to minimize the electrical shock hazard. The power supply 57 also includes a power-on reset circuit that emits a pulse on line 76 for a brief period following the initial application of electricity to reset the microcomputer 62.

As illustrated in FIG. 2, the modular configuration of the faucet 10 facilitates servicing its electrical and mechanical components. With the valve stem 24 uncoupled from the water supply and the lavatory 11, the base 15 can be removed from the faucet body 12. In this state of disassembly, the valve assembly 20 can be removed from within the faucet body by pulling the assembly out of engagement with the opening 19 in the inner wall 25. By providing a sliding engagement of the valve assembly 20 with the faucet body 12 at opening 19, a more compact faucet body can be used than if a threaded interface was employed. When a threaded interface is used, the inner chamber 18 of the faucet body has to be enlarged to allow the valve assembly to turn as it threaded into the opening 1. The valve assembly 20 can be further disassembled to gain access to the diaphragm 34 or to replace the solenoid assembly 50. The printed circuit board 61 can also be removed from the housing 12.

Figure 4A:
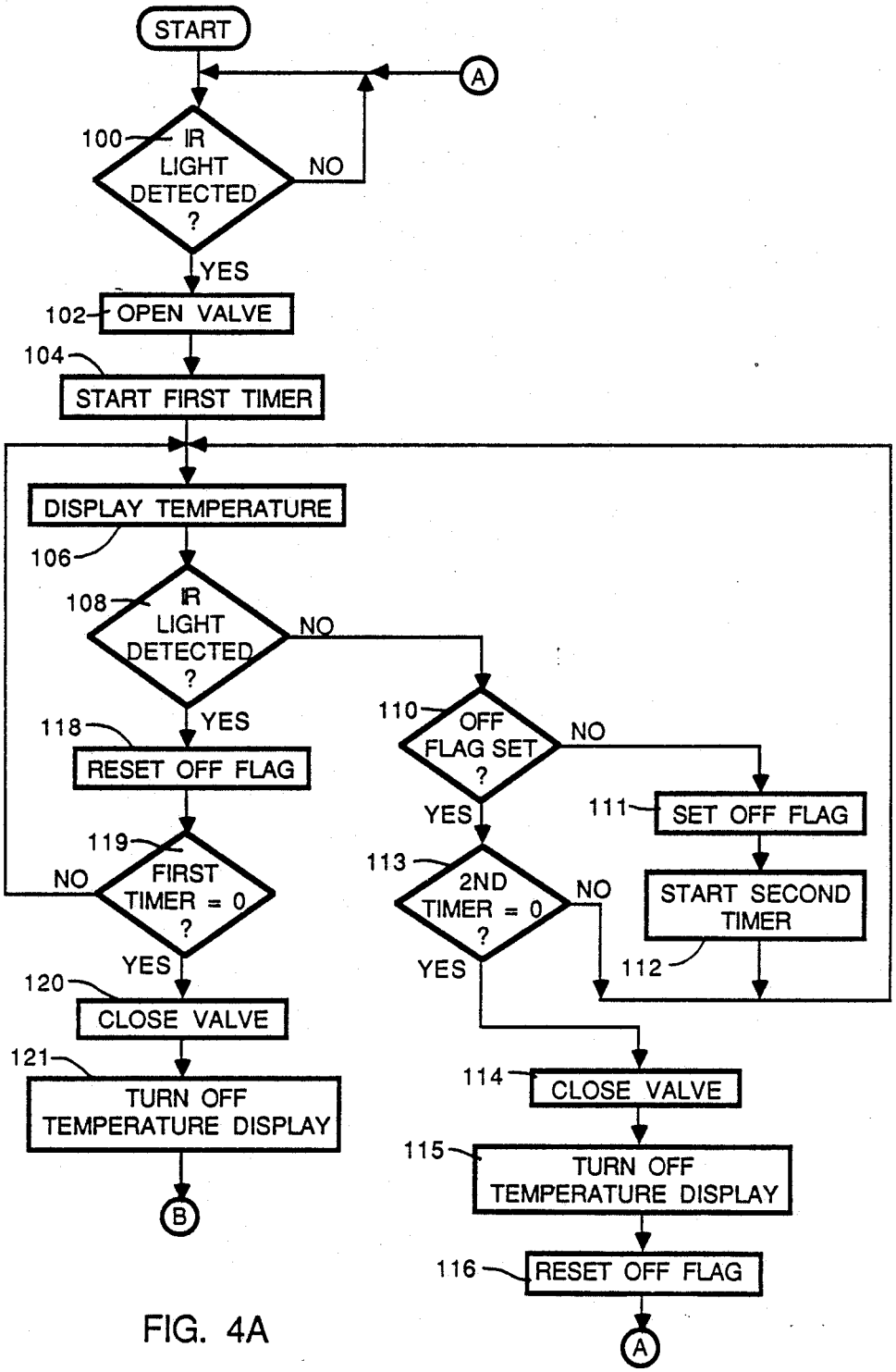
FIGS. 4A and 4B are a flowchart of a program for the control circuit microcompter.

The operation of the faucet 10 will be described in terms of the flow chart in FIGS. 4A and 4B in conjunction with FIGS. 2 and 3. The flow chart depicts the control program stored within the memory of the microcomputer 62. The execution of the control program commences at step 100 where the microcomputer tests the input bit from the frequency detector 72 to determine if infrared light from the IR LED 68 has been reflected by an object in front of the faucet. The frequency detector 72 provides a positive light detection signal to the microcomputer only when infrared light pulses are received at the same frequency as the oscillator 69. The frequency detector 72 thereby prevents ambient infrared radiation from falsely opening the faucet. If the output of the frequency detector 72 does not indicate that proper infrared light has been detected, the program continues to cycle through the detection step 100.

Once infrared light reflected from the emitter 68 has been detected at step 100, the program advances to step 102 where the microcomputer 62 energizes the solenoid coil 52 by sending a positive output signal to driver 74. With reference to FIG. 2, when the solenoid coil 52 is energized, a magnetic field is created which draws the plunger 56 into the coil and away from abutment against the diaphragm retainer 36. This allows the pressurized water within the cavity 46 on the solenoid side of the diaphragm 34 to escape through the retainer aperture 38 into the outlet chamber 23. It is noted that the metering hole 41 is restricted by pin 40 so that water escaping through aperture 38 cannot be replaced as quickly by water from inlet 22. With the plunger 36 no longer pressing against the retainer 36, and with the release of the pressure within cavity 46, the pressure of the water within the inlet chamber 22 pushes the diaphragm 34 toward the solenoid assembly 50 and away from abutment with the valve seat 30. This movement of the diaphragm 34 opens a more direct passage between the inlet chamber 22 and the outlet chamber 23 allowing water to flow through faucet and out the spout 13. This passage remains opened as long as the solenoid coil 52 is energized.

Referring once again to the flow chart of FIG. 4, after the valve is opened, a first software timer is started at step 104. The first timer provides a safeguard so that after a given interval, the diaphragm 34 will be closed against the valve seat regardless of the continued presence of an object being detected. This prevents the water from flowing continuously if an object is left in front of the faucet. When the first timer is started, it is initialized for a time interval (e.g. thirty seconds) which is sufficiently long to enable a user to wash his or her hands. Thereafter, the timer is periodically decremented at a fixed rate so that it will reach zero when the selected interval has expired.

At step 106, the microcomputer 62 reads the output from its integral analog-to-digital converter to determine the temperature of the water in the output chamber 23. The sensed temperature is then used to set various ones of the output port lines which are connected to the display 16 to provide an indication of the sensed temperature. For example, if the range of temperatures for the outlet water is between 70 and 50 degrees Fahrenheit, each light emitting diode of the array 16 corresponds to a ten degree increment within that range. In this case, if the temperature of the output water is 130 degrees Fahrenheit, six LED's will be illuminated.

The microcomputer 62 checks the output from the frequency detector 72 again at step 108 to determine if infrared light from the IR LED 68 is still being received. If this light is no longer being detected, the program branches to step 110. A branch at this point indicates that the object, which triggered the flow of water, has been removed from the sensing region of the faucet. This may occur if the user has left the lavatory or if the user's hands have been removed temporarily from beneath the faucet, for example to apply soap. Since it is not desirable to turn off the water if the user has merely removed his hands to apply soap, the control program provides a delay before turning off the water. If an object is again detected within this delay period, the water is not turned off. This is accomplished by initially testing a flag, designated as the off flag, which is stored within the memory of the microcomputer 62 and which indicates the first time that light is no longer detected after the presence of an object had been sensed. If at step 110, the off flag is not found to be set, the program branches to step 111 where it is set and then a second software timer for the shut-off delay is started at step 112. The second timer may be initialized to provide a three second delay for shutting off the water.

Once the second timer has been started, the program returns to step 106 to update the temperature display and again check for the receipt of infrared light at step 108. If at step 108, pulsed infrared light is still not being sensed, the program advances through step 110 to step 113. At this point, the second timer is checked to determine if it has reached zero indicating that light has not been received for the three second water shut-off delay period. If this timer has not reached zero, the program execution returns from step 113 to step 106. However, when the second timer indicates that the shut-off delay interval has elapsed, the program advances to steps 114 and 115 where microcomputer 62 turns off the temperature display and resets the off flag. Next the microprocessor 62 deenergizes the solenoid coil 52 to close the faucet valve at step 116. When the solenoid coil 52 is not generating a magnetic field, the force of spring 58 presses the sealing button 57 against the diaphragm retainer 36 (see FIG. 2). This action seals the retainer aperture 38 causing the pressure in cavity 46 to increase above the pressure in outlet chamber 23 due to the water flow through holes 40 and 41. As a result of this pressure differential the diaphragm 34 is forced against the valve seat 30 closing the passage between the inlet and outlet chambers 22 and 23. As the diaphragm 34 approaches the valve seat 30, the tapered pin 40 increasingly restricts the water flow through metering hole 41. This action reduces the speed of the final movement of the diaphragm 34 thereby minimizing the concussive shock (and thus noise) as the valve closes. In addition, the pin 40 prevents particles in the water from blocking the metering holes 41 and 42.

As long as light pulses from the IR LED 68 continue to be reflected by an object to infrared detector 70, the control program execution will advance from step 108 to step 118. At this point, the off flag is reset in the event that it had been previously set by the temporary removal of the user's hands. The program then checks the first software timer at step 119 to determine if the water has been turned on for longer than the thirty second operating interval. If the first timer has not expired, the program execution returns to step 106 to update the temperature display and again sense for infrared pulses at step 108.

If the valve remains open for more than thirty seconds and the object's presence is still detected, the program will advance from step 119 to step 120 where the solenoid coil 52 is deenergized and the valve closed, notwithstanding the continued presence of the object being detected. In this case, it is assumed that an inanimate object has been left within the sensing area of the faucet. However, if a user is still at the lavatory 11 and desires additional water, the users hands merely have to be removed from the sensing region of the faucet 10 and then returned to that region to restore the flow of water. After closing the valve at step 120, the microcomputer 62 resets latches output port 63 so that temperature is not displayed when the valve is closed. The program then advances to step 122 on FIG. 4B.

Figure 4B:
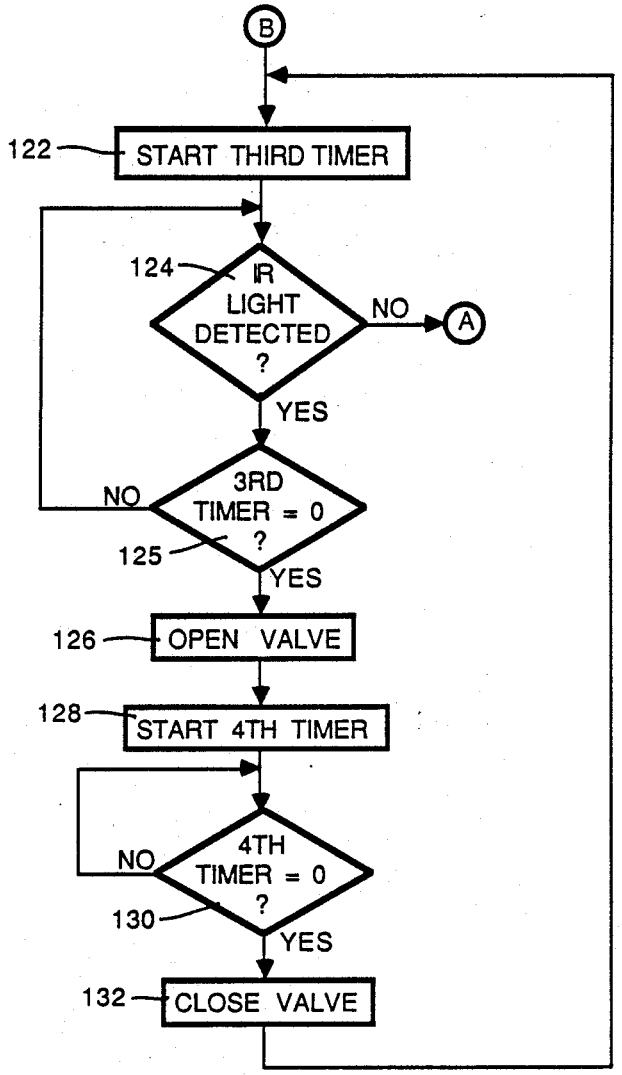

The section of the control program depicted in FIG. 4B periodically opens the valve for a brief interval until the object is removed from the sensing area of the faucet 10. The microcomputer 62 at step 122 initializes a third software timer with a relatively long interval, on the order of two hours for example. During this interval the valve remains closed as long as the presence of the object continues to be sensed. After starting the third timer, the execution of the control program enters a loop in which tests for the continued detection of pulsed infrared light at step 124. If light ceases to be detected, the program execution immediately returns to step 100 at the beginning of the control program. However, if pulsed light from IR LED 68 continues to be detected at step 124, the third timer is tested at step 125. If this timer has not expired, the program loops back to step 124.

Once this relatively long interval has elapsed as indicated by a third timer reaching zero, the program execution advances to step 126 where the valve is opened by energizing the solenoid coil 52. Then at step 128, a fourth software timer is started to measure a relatively small interval on the order of one to three seconds, during which the valve remains open. The microcomputer 62 continues to sense the value of the fourth timer at step 130 until it has expired; at which point the program advances to step 132 where the valve is closed. Upon closing the valve, the program execution returns to step 122 where the third software timer is initialized for another relatively long interval.

As long as the presence of the object continues to be sensed by the control circuitry, the microprocessor 62 continuously executes the program loop of FIG. 4B. In order to exit this loop, the object must be removed from the sensing region of the faucet upon which event the program execution returns from step 124 to step 100. By periodically opening the faucet 10 for a short interval, the control circuit provides an indication that an object remains within its sensing area, enabling a maintenance person to be warned of this condition and remove the object. The cycling between open and closed states of the valve also distinguishes the mode of operation in which the faucet perceives the continued presence of an object from the condition where the faucet is inoperative due to a malfunction.

The relatively long interval of inoperability may be shortened in order to provide a more frequent indication of this mode of operation.

We claim:

1. A faucet comprising:

a faucet body having an inner chamber and a spout which opens into the inner chamber at an aperture through an inner wall of said body;

a valve housing, mounted substantially entirely within the inner chamber of said faucet body and separable therefrom, having a inlet chamber opening transversely into an external annular channel and an outlet chamber having a first opening centrally located relative to said annular channel, said valve housing having an annular surface between the channel and the outlet chamber first opening thereby defining a valve seat, said valve housing a first portion slidably disposed in the aperture and a second portion secured to said faucet body;

a resilient diaphragm having a first surface that releasably engages the valve seat and has a periphery which sealably engages said valve housing, said diaphragm including a central aperture and including a metering aperture communicating with the inlet chamber;

a tapered pin extending from said valve housing into the metering aperture;

a diaphragm retainer in the central aperture of said diaphragm and having an aperture therethrough which communicates with the outlet; and a solenoid assembly mounted on said valve housing to form a cavity between said diaphragm and said solenoid assembly into which the metering aperture communicates, said solenoid assembly including a plunger biased against said diaphragm retainer to releasably seal the aperture of said diaphragm retainer, and including a electrical coil around the plunger.

2. The faucet as recited in claim 1 wherein said first portion engages the inner wall of said faucet body thereby sealing the inner chamber from the spout with the portion of the valve housing having an aperture therethrough to provide a passage between the outlet chamber and the spout.

3. The faucet as recited in claim 1 wherein said first portion extends into the aperture of said faucet body thereby sealing the inner chamber from the spout with the portion of the valve housing having an aperture therethrough to provide a passage between the outlet chamber and the spout.

4. The faucet as recited in claim 1 wherein said valve housing is mounted within said faucet body with the outlet chamber positioned above the inlet chamber.

5. The faucet as recited in claim 1 further comprising a proximity sensing means for detecting the presence of an object adjacent the faucet and in response thereto for energizing the electrical coil.

6. The faucet as recited in claim 5 wherein said proximity sensing means comprises means for deenergizing the electrical coil if the presence of the object continues to be sensed for a predefined interval of time, and thereafter periodically energizing the electrical coil for a second predefined interval of time until the presence of the object is no longer sensed.

7. A faucet comprising:

a housing having an inlet chamber and an outlet chamber communicating with the inlet chamber at an opening;

a solenoid valve assembly mounted adjacent said housing which releasably seals the inlet chamber from the outlet chamber for controlling fluid flow therebetween;

means for sensing the presence of an object in the proximity of said faucet and emitting a signal indicative of that presence;

means, responsive to the signal from said means for sensing, for energizing said solenoid valve assembly to permit fluid flow when the presence of an object is sensed;

first means for deenergizing the solenoid valve assembly to prevent fluid flow if after the presence of an object is detected, that presence is not detected for a first interval of time; and second means for deenergizing said solenoid valve assembly after the solenoid valve assembly to prevent fluid flow has been continuously energized for a second interval, notwithstanding the continued presence of the object being sensed, and thereafter periodically energizing said solenoid valve assembly to permit fluid flow for a third interval of time until the presence of the object is no longer sensed.

8. A faucet comprising:

a base member;

a faucet body, attached to said base member, having an inner chamber and a spout which opens into the inner chamber at an aperture;

a valve housing, within the inner chamber of said faucet body and separable therefrom, having a inlet chamber opening into an external annular channel and an outlet chamber having a first opening centrally located relative to said annular channel, said housing having an annular surface between the channel and the outlet chamber first opening thereby defining a valve seat, said valve housing also having a first end portion extending into the aperture of said faucet body thereby sealing the inner chamber from the spout with the first end portion having a aperture therethrough to provide a passage between the outlet chamber and the spout, and having a second end portion;

a tube attached to the second end portion of said valve housing in communication with the inlet chamber;

one of said valve housing and said tube abutting said base thereby retaining said valve housing within said faucet body and holding said first end portion in the aperture of said faucet body;

a resilient diaphragm having a first surface that releasably engages the valve seat and has a periphery which sealably engage said valve housing, said diaphragm including a central aperture and a metering aperture communicating with the inlet chamber;

a tapered pin extending from said valve housing into the metering aperture;

a diaphragm retainer in the central aperture of said diaphragm and having an aperture therethrough which communicates with the outlet chamber;

a solenoid assembly mounted on said valve housing to form a cavity between said diaphragm and said solenoid assembly into which the metering aperture communicates, said solenoid assembly including a plunger biased by a spring against said diaphragm retainer to releasably seal the aperture in said diaphragm retainer and including a electrical coil around the plunger; and a means for sensing the presence of a user adjacent the faucet and in response thereto for energizing said electrical coil.

9. The faucet as recited in claim 8 further comprising a first means for deenergizing the solenoid valve assembly if after the presence of an object is detected, the presence is not detected for a first interval of time.

10. The faucet as recited in claim 9 further comprising a second means for deenergizing said solenoid valve assembly after the solenoid valve assembly has been continuously energized for second interval, notwithstanding the continued presence of the object being sensed, and thereafter periodically energizing said solenoid valve for a third interval of time until the presence of the object is no longer sensed.

* * * * *